US012534968B2

(12) United States Patent
El Mallawany et al.

(10) Patent No.: US 12,534,968 B2
(45) Date of Patent: Jan. 27, 2026

(54) SPLICE FREE FEEDTHROUGH MECHANICAL PACKER

(71) Applicant: Halliburton Energy Services, Inc., Houston, TX (US)

(72) Inventors: Ibrahim El Mallawany, Al-Khobar (SA); Eddie Perez, Dhahran (SA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/594,360

(22) Filed: Mar. 4, 2024

(65) Prior Publication Data

US 2025/0277420 A1 Sep. 4, 2025

(51) Int. Cl.
*E21B 23/06* (2006.01)
*E21B 33/129* (2006.01)

(52) U.S. Cl.
CPC ..... *E21B 23/06* (2013.01); *E21B 33/129* (2013.01)

(58) Field of Classification Search
CPC ..... E21B 23/06; E21B 23/00; E21B 33/129; E21B 33/1208; E21B 33/12
See application file for complete search history.

(56) References Cited

U.S. PATENT DOCUMENTS 5,636,689 A 6/1997 Rubbo et al.
5,808,192 A * 9/1998 Schmidt ..... E21B 43/14 73/152.55
5,906,240 A 5/1999 Kilgore et al.
8,037,938 B2 * 10/2011 Jardim De Azevedo ..... E21B 33/126 166/242.6
8,863,832 B2 * 10/2014 Du ..... E21B 17/10 166/189
9,447,653 B1 * 9/2016 Abi Aad ..... E21B 33/127
10,174,582 B2 * 1/2019 Windegaard ..... E21B 33/1294
10,954,762 B2 * 3/2021 Patel ..... E21B 47/12
11,111,764 B2 * 9/2021 Molstre ..... E21B 34/10
11,788,366 B2 * 10/2023 Herndon ..... E21B 33/1295 166/387
2015/0226023 A1 8/2015 Scruggs et al.
2016/0010422 A1 * 1/2016 Goodman ..... E21B 33/1208 166/179
2016/0326822 A1 * 11/2016 Tait ..... E21B 29/04
2019/0100978 A1 4/2019 Carmody et al.
2020/0095837 A1 * 3/2020 Bringham ..... E21B 23/06
2023/0287759 A1 * 9/2023 Polo Terán ..... E21B 33/14
2023/0332497 A1 * 10/2023 McGuigan ..... E21B 47/01

FOREIGN PATENT DOCUMENTS

CA 2985443 A1 * 5/2018 ..... E21B 17/026

OTHER PUBLICATIONS

"PCT Application No. PCT/US2024/057931 International Search Report and Written Opinion", Mar. 7, 2025, 11 pages.

* cited by examiner

*Primary Examiner* — Aaron L Lembo
(74) *Attorney, Agent, or Firm* — DeLizio, Peacock, Lewin & Guerra LLP

(57) ABSTRACT

Disclosed herein are embodiments of an apparatus and method related to a splice-free feedthrough mechanical packer. In one embodiment, an apparatus to be positioned in a wellbore comprises a packer mandrel; and a packing element assembly including at least a packing element and an interior channel; wherein a continuous control line is configured to be installed external to the packer mandrel and positioned in the interior channel of the packing element assembly without being spliced.

18 Claims, 13 Drawing Sheets

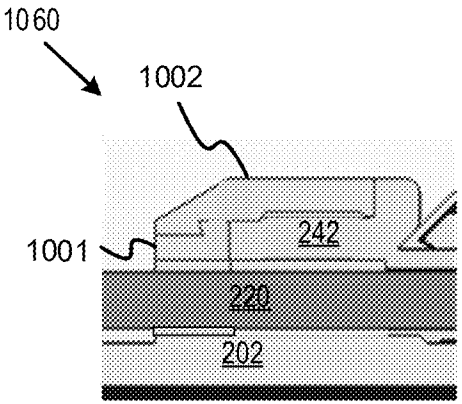
FIG. 10A
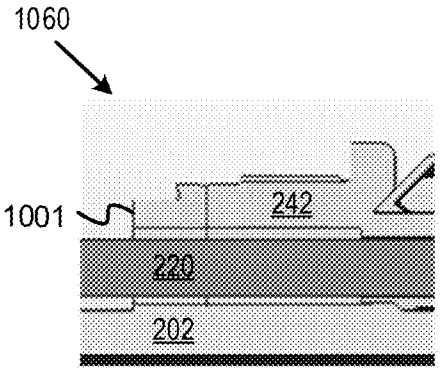
FIG. 10B
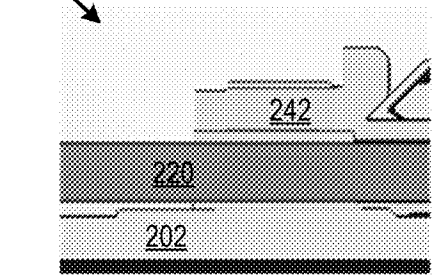
FIG. 10C
FIG. 10D
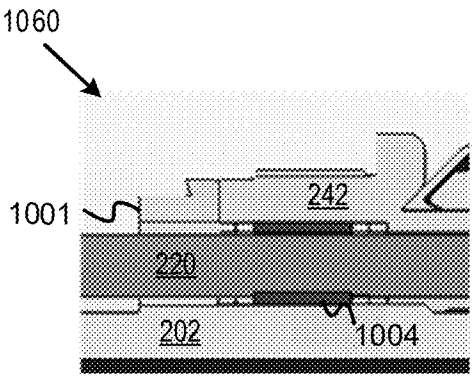
FIG. 10E
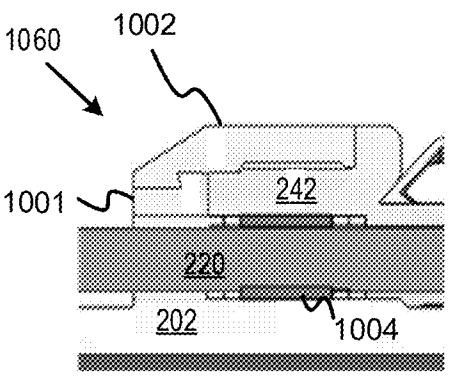
FIG. 10F

SPLICE FREE FEEDTHROUGH MECHANICAL PACKER

FIELD OF THE DISCLOSURE

Some implementations relate generally to the field of downhole tools positioned in a wellbore completion and more particularly to the field of mechanical packers in wellbore completions.

BACKGROUND

When a well is completed, prior to production, a completion string is run into the well. On run in the string must be open to allow fluid to flow up the tubing of the string. The tubing must be sealed so that sufficient downhole pressure can be created to set the production packer mounted on the string and together provide a downhole barrier. The barrier thus allows pressure testing to be undertaken prior to the tubing string being opened so that produced oil can flow up the completion string to the surface. Control lines may be run through various downhole tools. Control lines may need to run along and downhole of a packer, but certain packers may not allow the control line to be positioned external to the packing element or may require splicing if fed internal of the packer element. What is needed is a control line that can be fed through and positioned internal to a packing element without needing to splice the control line.

BRIEF DESCRIPTION OF THE DRAWINGS

Implementation of the disclosure may be better understood by referencing the accompanying drawings.

FIG. 10A-10F are side views of a sealing and locking element for a packer, at different stages of installation, according to some implementations.

DESCRIPTION

Figure 1:
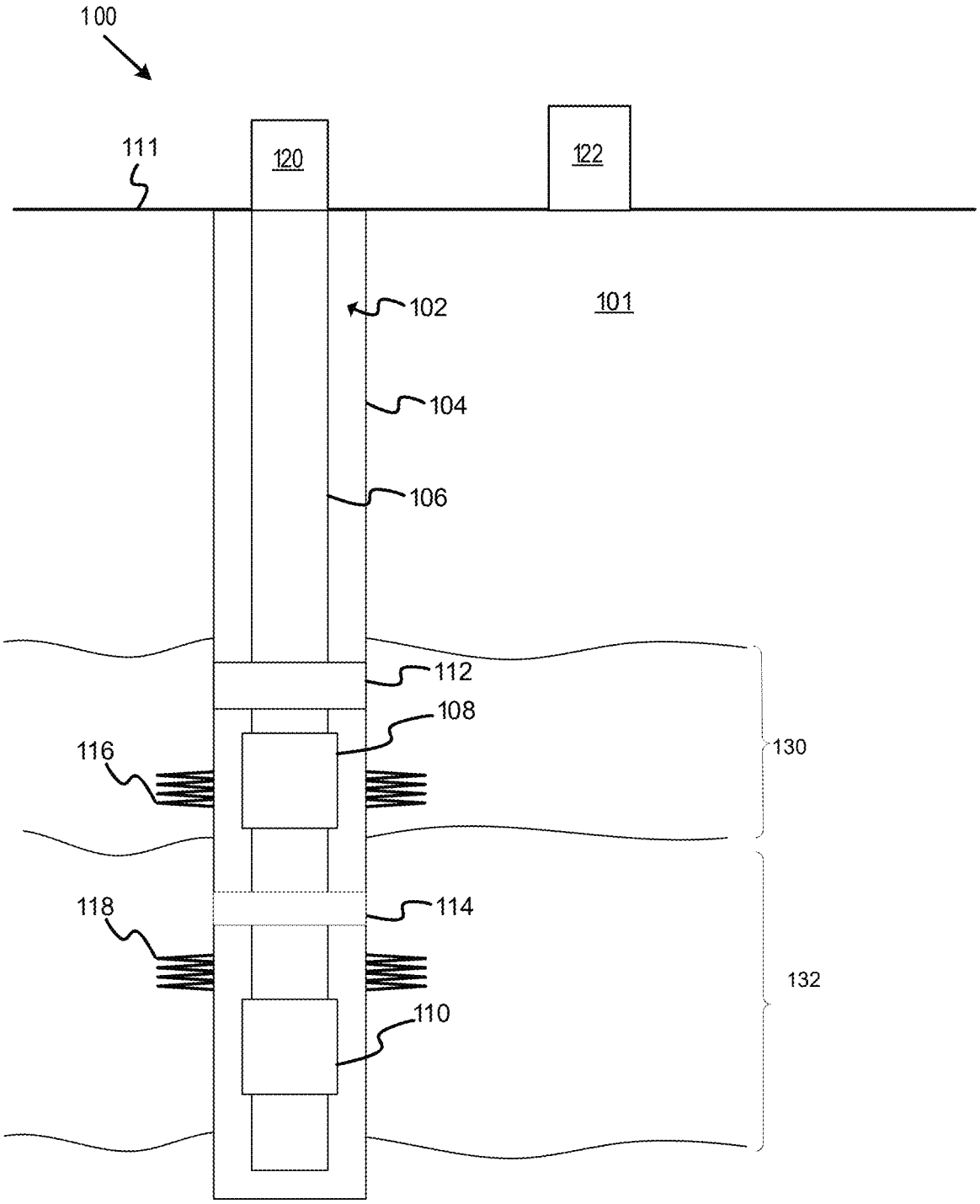
FIG. 1 is a diagrammatic illustration of an example well system, according to some implementations.

The description that follows includes example systems, methods, techniques, and program flows that embody aspects of the disclosure. However, it is understood that this disclosure may be practiced without these specific details. For instance, this disclosure refers to one or more components configured to induce vibrations for an impulse turbine in a wellbore. Aspects of this disclosure can also be applied to other components and/or a combination of components configured to induce vibrations for an impulse turbine positioned in wellbore. For clarity, some well-known instruction instances, protocols, structures, and techniques have been omitted.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

Feedthrough mechanical packers can be set quickly but require splicing or cutting of control lines. Splicing or cutting the control lines to be fed through or placed internal to the packing element may result in a leak path and/or be detrimental to the signal quality for fiber optic and electric lines. The splicing process also requires additional operational time on the rig floor during installation. Certain swell packers may provide control line feedthrough without splicing, but swelling time is not fully controlled which may delay rig operations. There is currently no solution for a splice free feed-through of control lines for mechanical packer applications.

Provided herein are embodiments of mechanical packers having feedthrough control lines fed through and internal to the packing element without the need for cutting or splicing. The feedthrough packers disclosed herein provide for the mechanical setting of the packers to be quicker and on demand, as opposed to swell packers. Non-spliced or cut control lines improve the signal for fiber optic and electric lines, and minimize leak paths for hydraulic lines, thereby increasing overall reliability. Eliminating control line splicing may also reduce deployment/installation times. Embodiments of the feedthrough packers disclosed herein may be used with permanent mechanical packers and retrievable packers.

In one embodiment, a packer may include a packer mandrel and a packing element assembly, the packing element assembly including at least a packing element and an interior channel. A continuous control line is configured to be installed external to the packer mandrel and positioned in the interior channel of the packing element assembly without being spliced.

In another embodiment, a wellbore system includes a downhole tool and a packer positioned uphole of the downhole tool, the downhole tool coupled with a control line from the surface. The packer includes at least a packer mandrel and a packing element assembly, the packing element assembly including at least a packing element and an interior channel. A continuous control line is configured to be installed external to the packer mandrel and positioned in the interior channel of the packing element assembly without being spliced.

In another embodiment, there is a method. The method includes mounting a control line on a rig for installation into a wellbore, and inserting the control line, uncut or unspliced, through a packing element assembly of a packer while the control line is mounted on the rig. The packing element assembly may include at least a packing element and an interior channel for positioning the control line therein. The packer may be positioned to be run into the wellbore, the packer including a packer mandrel. The control line may be laid externally over the packer mandrel and then the packer element assembly is coupled with the packer mandrel.

Example Systems

FIG. 1 is a diagrammatic illustration of an example well system, according to some implementations. In particular, a well system 100 of FIG. 1 includes a wellbore 102 in a subsurface formation 101. The wellbore 102 includes casing 104 and number of perforations 116, 118 being made in the casing 104. Each set of perforations 116, 118 is located in a respective reservoir 130, 132 to allow reservoir fluids (i.e., oil, water, and gas) from the respective reservoirs 130, 132 to flow into the wellbore 102 and into the tubular string 106 (the production tubing or drill string). The tubular string 106 may include one or more packers, such as packer 112 and 114 that may prevent the comingling of fluids produced from the reservoirs 130, 132 in the wellbore 102. A production assembly 108 may allow the inflow of fluid produced from the reservoir 130 into the tubular string 106. Likewise, a production assembly 110 may allow the inflow of fluid produced from the reservoir 132 into the tubular string 106.

Each of the production assemblies 108, 110 may include one or more downhole tools (not pictured). Some examples of downhole tools may include inflow control valves (ICVs), permanent downhole gauges, chemical injection mandrels, fiber optic sensors, and more. In some implementations, the downhole tools may be configured to control the flow of fluid produced from the reservoirs 130, 132 and into the tubular string 106. In some implementations, each of the production assemblies 108, 110 may also include electronics to control (e.g., for controlling timing, directionality, and/or voltage threshold for powering and/or activating the downhole tool) the respective downhole tools. Control lines may be run downhole to the production assemblies. In many implementations, the control lines may include fiber optic and electric lines to power and communicate with permanent downhole gauges. In some embodiments, the control lines may include a plurality of individual control lines, or may be bundled into a pack or conduit, such as a flatpack.

Provided herein are embodiments of mechanical packers having feedthrough control lines fed through and internal to the packing element without the need for cutting or splicing. The packer may have a central packer mandrel and a packing element assembly configured to receive the control lines internal to the packing element assembly. Some examples may also include a lower assembly, which may include an external channel for receiving the control line therein and may also include traditional components of a packer including a setting piston, an upper cone, an anchoring element, such as slips, and a lower cone. The packing element assembly includes at least a packing element and an internal channel for the control line, and may in some examples include an element mandrel beneath the packing element and a sleeve, wherein the sleeve engages the setting piston when the packing element assembly is coupled with the lower assembly. The packer may also include an anti-preset and locking mechanism such as included with traditional mechanical packers.

Example Assembly

Figure 2A:
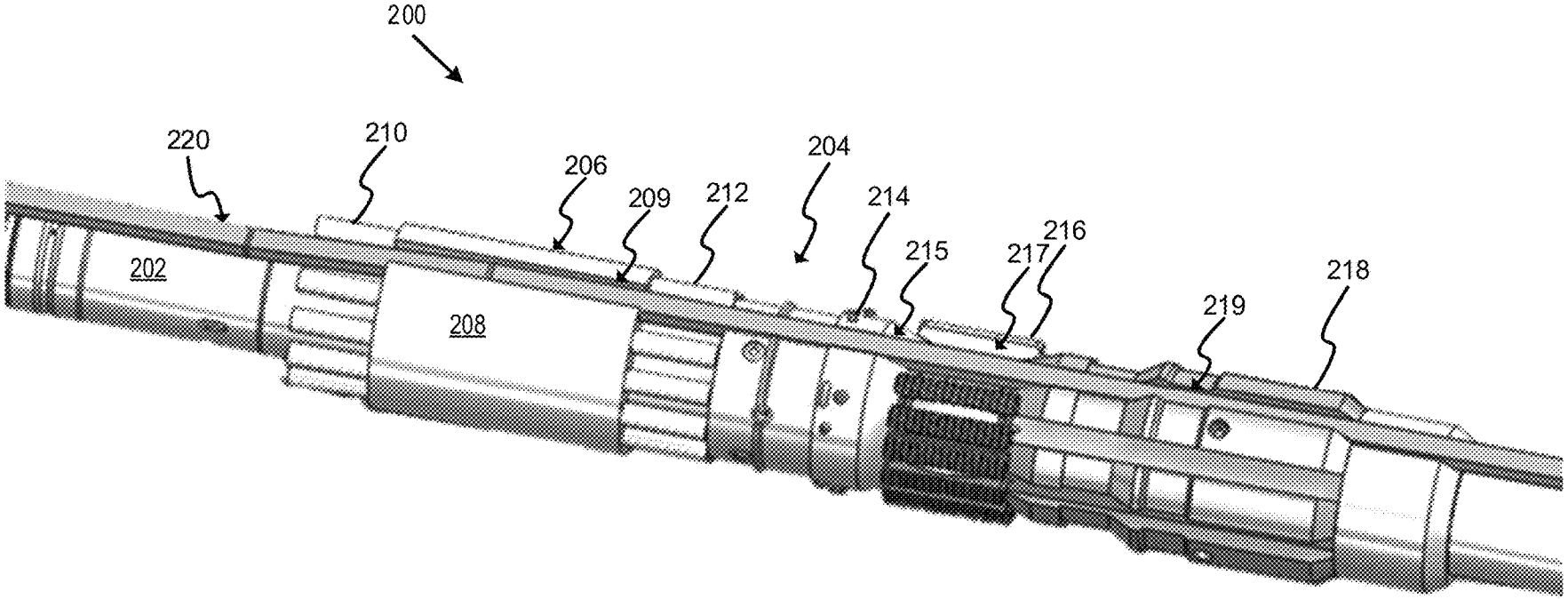
FIG. 2A is a perspective view of one embodiment of a mechanical packer and a lower assembly thereof, according to some implementations.
Figure 2B:
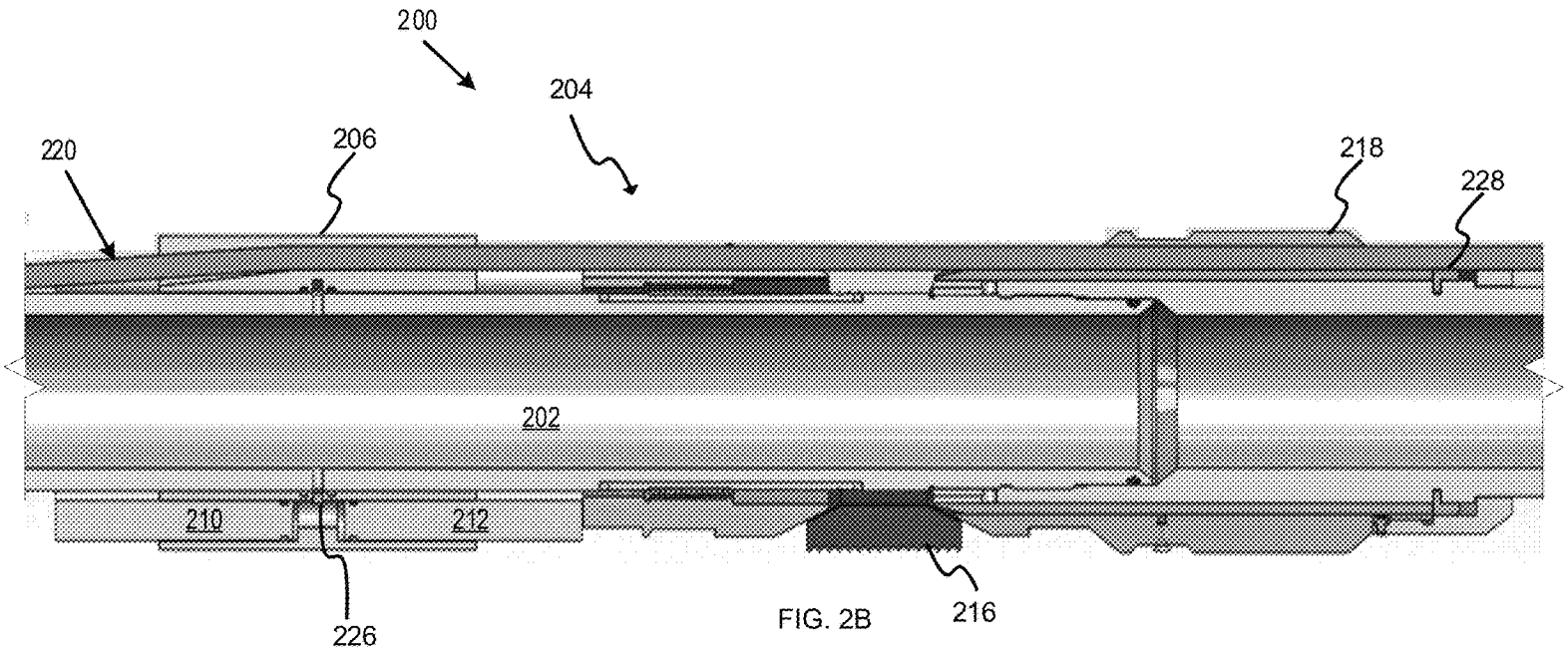
FIG. 2B-2C are side view of the mechanical packer shown in FIG. 2A.
Figure 2C:
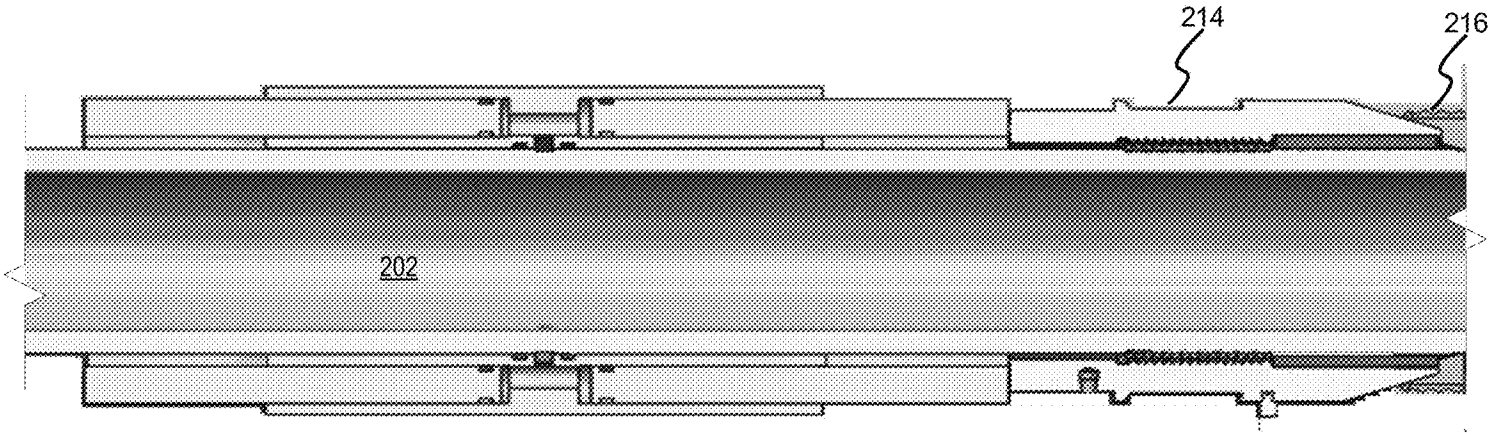

FIG. 2A-2C illustrates one embodiment of a mechanical packer 200. The packer 200 includes a tubing or packer mandrel 202 having a lower assembly 204 coupled thereabout. The packer 200 includes a packing element assembly, which will be shown in FIG. 4 and FIGS. 5A-5C and described herein, wherein the packing element assembly will include at least a packing element and an interior channel. The packer 200 may include at least a setting element, which in this embodiment is a setting piston 206 of the lower assembly 204. The piston 206, in this embodiment, includes a central member 208 with upper cylinders or rods 210, and lower cylinders or rods 212 on each side of the central member 208. Positioned below, or downhole of the piston 206 is an anchoring element 216 for anchoring the packer 200 with the wellbore casing, The anchoring element 216 may be slips as shown in FIG. 2A. The anchoring element 216 may be positioned between an upper cone 214 and a lower cone 218.

One or more control lines 220 will be laid over the lower assembly 204 of the packer 200 externally such that the control lines 220 connected with one or more downhole tools positioned downhole of the packer 200 can be fed through without splicing. The control line 220 may include one or more individual control lines or may be a flat pack with a plurality of control lines (hydraulic, electric, and/or fiber optic lines) contained within. Each of the components of the lower assembly 204 may be constructed with at least one external channel for receiving the control line 220 on an external surface. The piston 206 may include one or more longitudinal channels 209 in an external surface of the central member 208 thereof. The upper cone 214 may include one or more openings or channels 215 in at least a portion of its external surface. The anchoring element 216, slips in this example, may be segmented such that there is one or more openings 217 between the slips such that the control line 220 may lay between two of the slips. The lower cone 218 may include a similar longitudinal channel 219 for the control line 220. Although the packer 200 illustrated is a retrievable packer with certain activation components thereof, the disclosure may be implemented on any variation of a mechanical packer, such as packers that do not have an anchoring element, and packers having different setting element configurations and features.

FIGS. 2B and 2C are side view of the lower assembly 204 and illustrate additional features such as a pressure port 226 in the mandrel 202 and a shear pin or shear ring 228 which illustrate certain features related to pressure setting the packer 200. Fluid internal of mandrel 202 may enter the pressure port 226 and pressure to apply a hydraulic force on pistons 210 and 212. The upper rods 210 will push upward to engage the packing element and the lower rods 212 will push downward and engage the upper cone 214, which will engage the anchor element 216. Shear pin 228 may hold the lower cone 218 in place to prop up anchor element 216 as upper cone 214 is pushed down. Once engaged by both the upper cone 214 and the lower cone 218, the anchor element 216 will move radially outward and engage a casing of the wellbore to anchor the packer 200 inside the casing.

Figure 3:
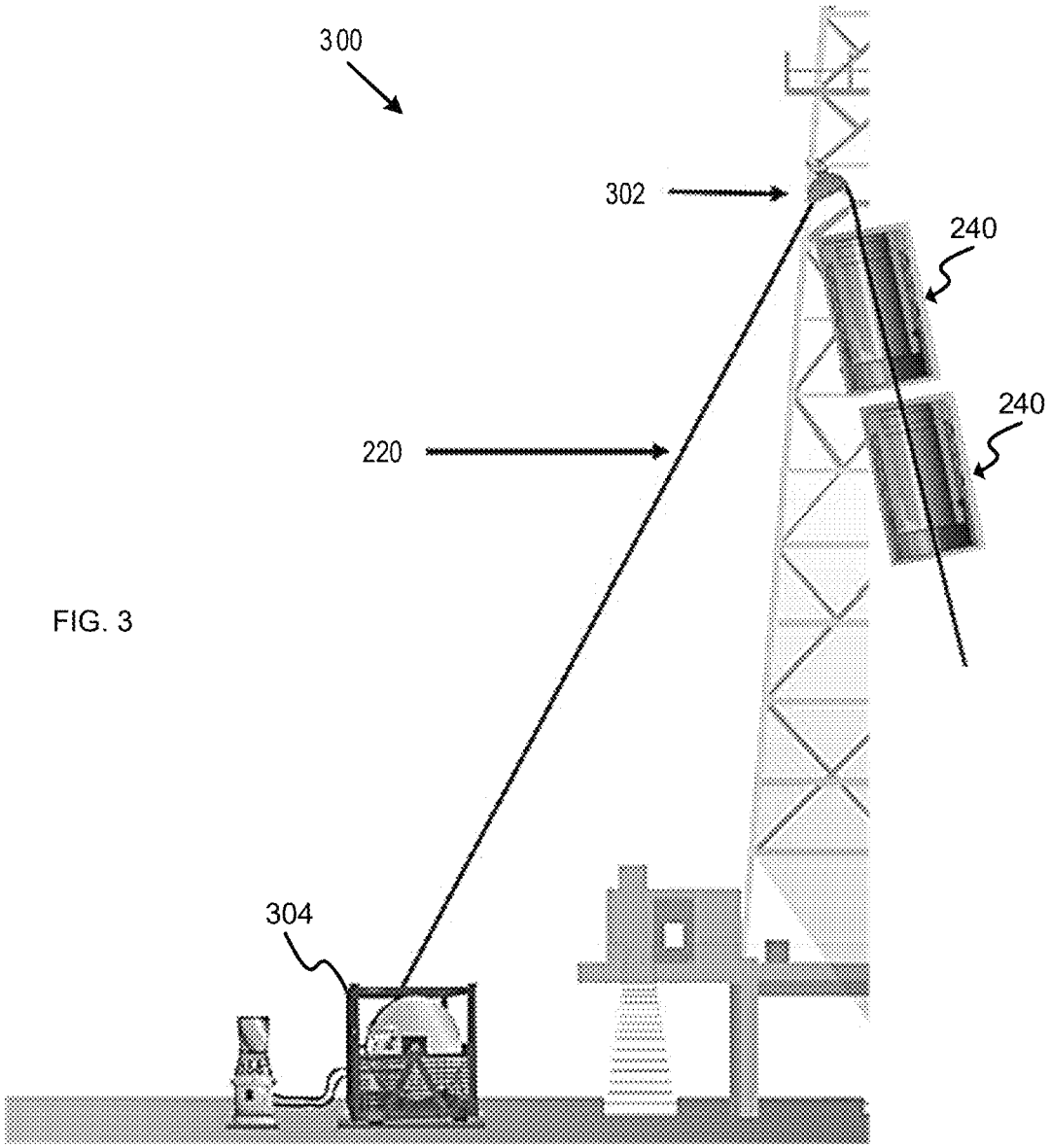
FIG. 3 is a diagrammatic illustration of a rig for installation of wellbore components, according to some implementations.

FIG. 3 is a perspective view of a rig 300 for installing tools into a wellbore. During preparation for an intelligent completion string to be run in hole, the control line 220 or flatpack will be mounted on the rig 300 and spooling 304, and fed through a sheave 302. The control line 220 may also be fed through one or more packing element assemblies 240. There will be a packing element assembly 240 for each packer to be installed downhole. The packing element assemblies 240 may be secured to the rig 300 in a way to ensure the packing elements do not get damaged.

Figure 4:
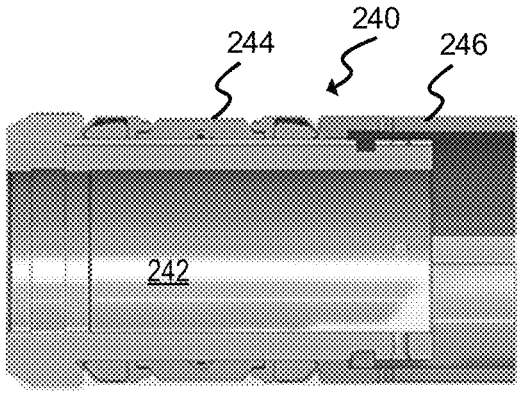
FIG. 4 is a side view of a packing element assembly of a packer, according to some implementations.

FIG. 4 is a side view of a packing element assembly 240 to be positioned onto a packer, such as packer 200, which may be being prepared to be run in hole. The packing element assembly 240 may also be called an element cartridge. The packing element assembly 240 may include an element mandrel 242 with a packing element 244 installed about the element mandrel 242. The packing element assembly 240 may also include a sleeve 246 for engaging and coupling with the packer mandrel 202, and in some examples engage the lower assembly 204. The packing element assembly 240 is configured to position the control line 220 internal to the packing element assembly, positioned at least between the packing element 244 and the packer mandrel, such as packer mandrel 202. In this embodiment, the control line 220 is also positioned internal to the element mandrel 242. In some examples, the packing element assembly 240 may include one or more components for setting the packing element, but in the illustrated example, the packing element is set by the setting piston of the lower assembly 204.

Figure 5A:
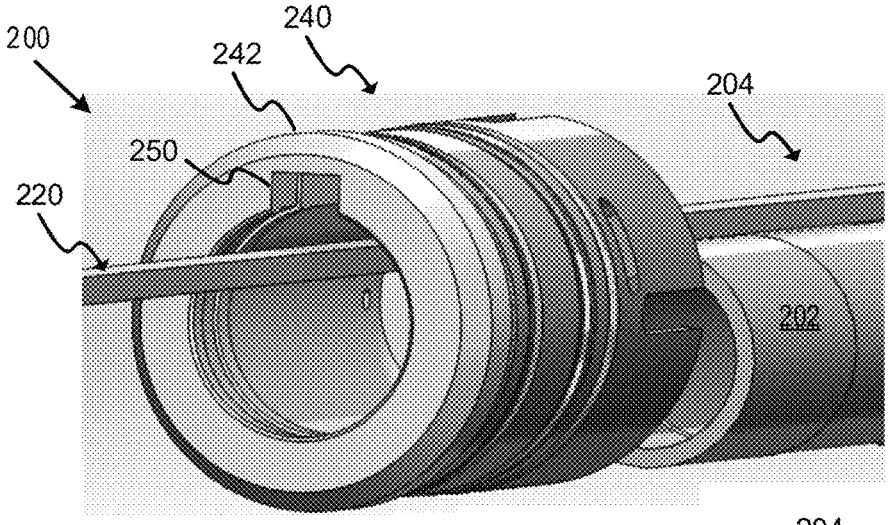
FIG. 5A-5C are perspective and side views of the packer, showing installation of the packing element assembly onto the lower assembly, according to some implementations.
Figure 5B:
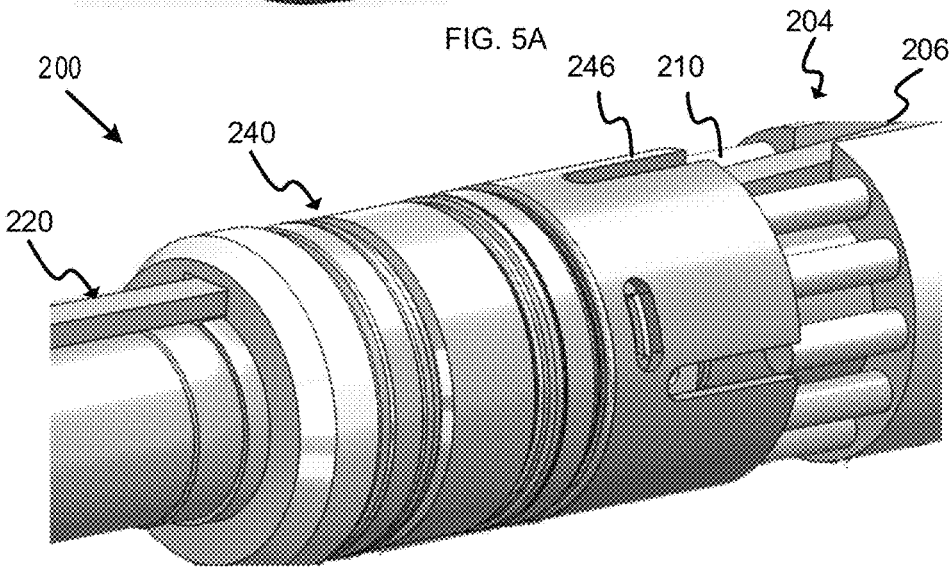
Figure 5C:
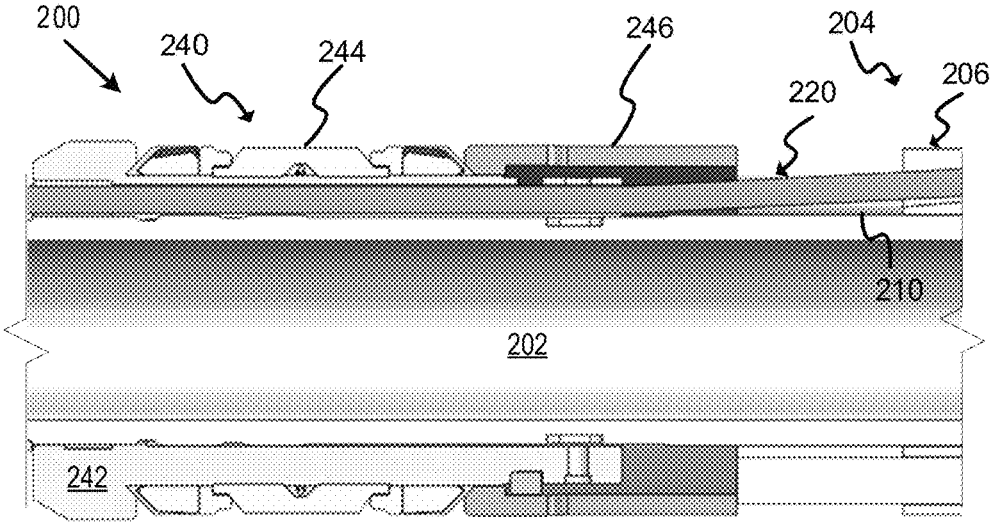

FIG. 5A-FIG. 5C illustrate different stages of installation of the control line 220 and packing element assembly onto the lower assembly 204 of packer 200. In FIG. 5A, there is shown a perspective view of the packing element assembly 240. The element mandrel 242 includes an internal groove or channel 250 on an inner surface thereof to fit the control line 220 or flat pack therein. When it is time to run the packer 200 in hole, the control line 220 will be laid over the packer mandrel 202 and externally over the lower assembly 204 as shown in FIG. 5A. Next, the packing element assembly 240 will be lowered onto the lower assembly 204 of the packer 200. The packing element assembly 240 will then be mounted onto the packer mandrel 202 and pushed onto the lower assembly 204 until the sleeve 246 shoulders onto and engages the piston assembly 206 as shown in FIG. 5B.

FIG. 5C is a side view showing the control line 220 positioned internally to the packing element assembly and external to the lower assembly. As shown, the control line 220 is positioned internal to the packing element assembly 240, positioned between the packing element 244 and the packer mandrel 202, and external to the lower assembly 204. In some embodiments, the control line 220 may run between two of the upper rods 210 and similarly between two of the lower rods (although not shown in FIG. 5C). When the packer 200 is set, the upper rods 210 of the setting piston will engage the sleeve 246, which may, in some examples, push uphole to engage the packing element 244 axially outward into engagement with the wellbore casing. The packer illustrated herein is a tubing conveyed packer and may be set by tubing pressure, but the packing element assembly and external channel of the lower assembly may be adapted for various types of mechanical packers.

Figure 6:
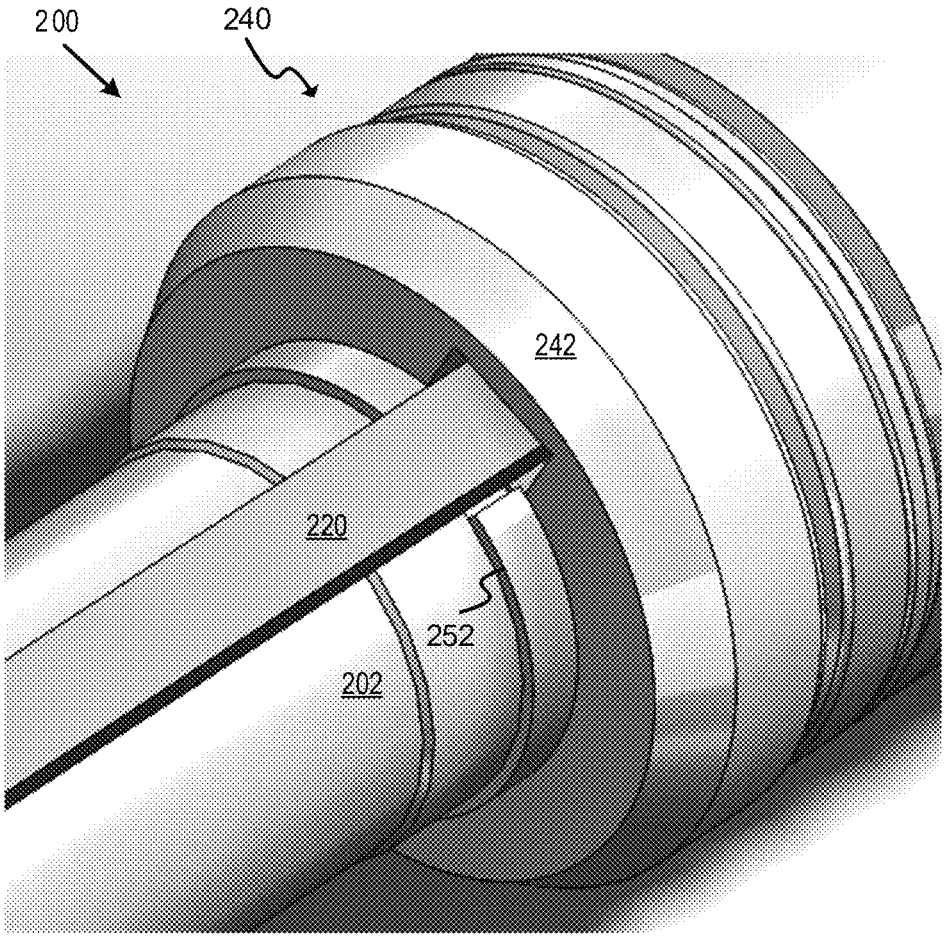
FIG. 6 is a perspective view of the assembled packer, according to some implementations.

Referring now to FIG. 6, after the packing element assembly 240 is positioned and engaged with the lower assembly, a locking element may be positioned about the packer mandrel 202 to axially lock the packing element assembly 240 into place. In this example, the locking element is a snap ring 252 positioned at an uphole end of the packing element assembly 240 to lock the packing element assembly 240 (element cartridge) in place to prevent movement thereof. In this example, the snap ring 252 is engaged with the element mandrel 242.

Figure 7A:
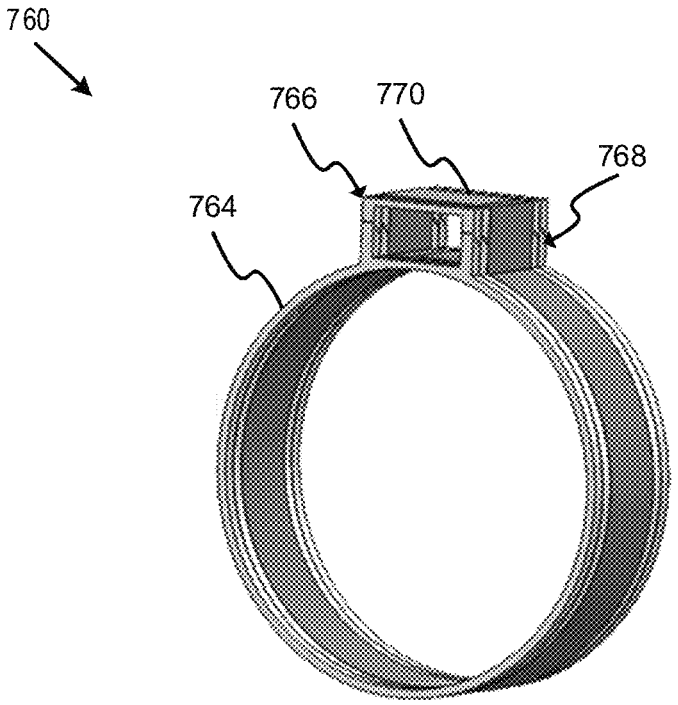
FIGS. 7A and 7B are perspective views of a sealing element, according to some implementations.
Figure 7B:
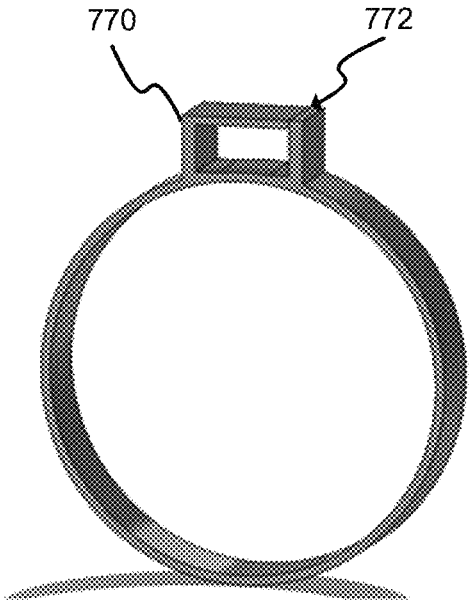

Referring now to FIG. 7A-FIG. 7B, there is shown a sealing member 760. The sealing member 760 may be placed between the packer mandrel and the packing element in order to seal the control lines or flatpack. In this example, the sealing member 760 may include a ring 764 with a housing 766 on an external surface thereof for receiving the control lines or flatpack. The housing 766 may include at least split 768 for placing the control line into the housing 766. The ring 764 and housing 766 may comprise one or more of any combination of elastomers, metals, and polymers, such as polyether ether ketone (PEEK) materials for anti-extrusion or other suitable materials. The metals may comprise a first portion and the peek materials may comprise an adjacent portion. The sealing member 760 in this example may also include an elastomer portion 770 for sealing the control line. The elastomer portion 770 may also include a least one split 772. Although the elastomer portion 770 is shown in FIG. 7B to include a ring, the elastomer portion may in some examples, comprise only a portion of the housing. Ideally the elastomer 770 may be a swellable rubber so it can have a slight clearance for ease of installation and then would swell when submerged in downhole fluids and create a seal when downhole. The seal prevents any pressure communication through the path created by the opening/channels for the control line.

Figure 8:
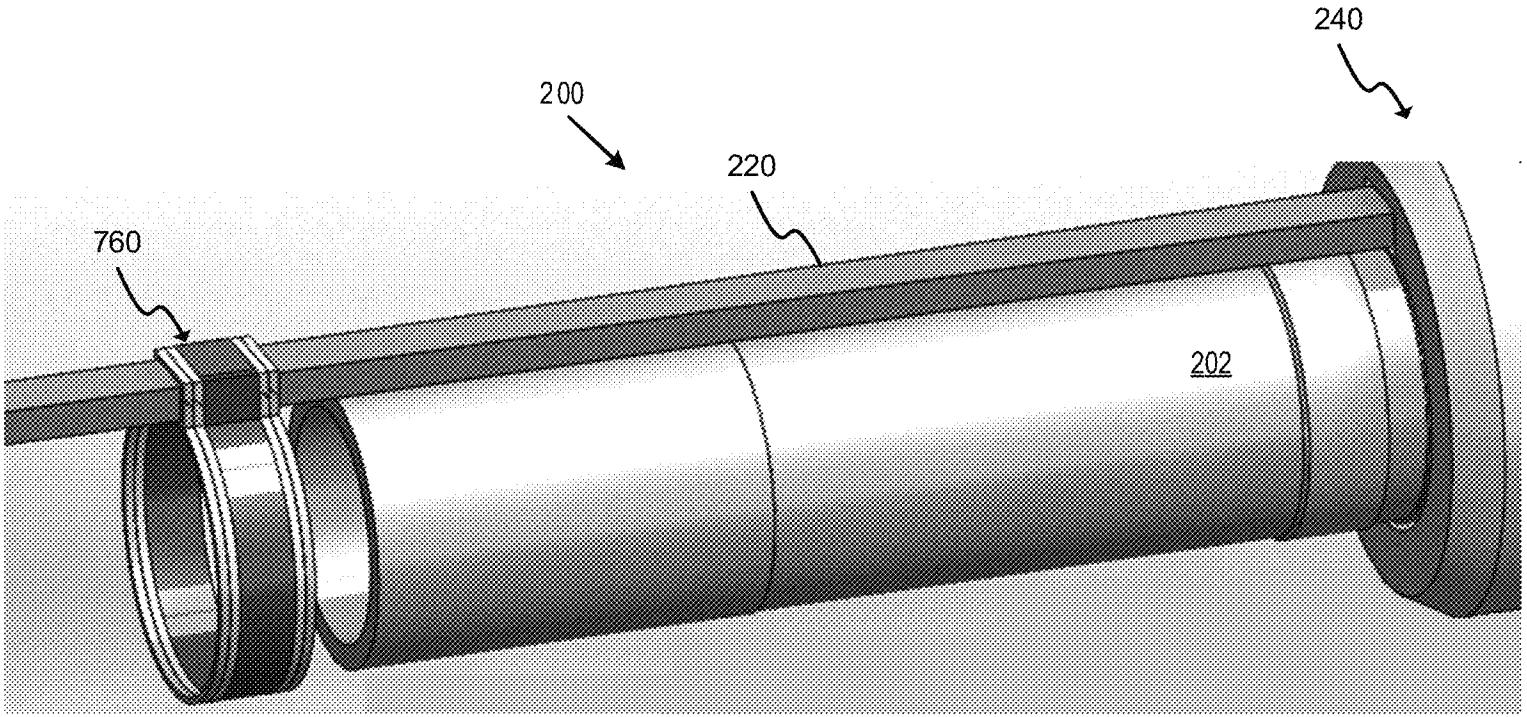
FIG. 8 is a perspective view of a packer with the sealing element, according to some implementations.

FIG. 8 is a perspective view of the packer 200 showing the sealing member 760 being installed about the packer mandrel 202 uphole of the packing element assembly 240 and about the control line 220.

Figure 9:
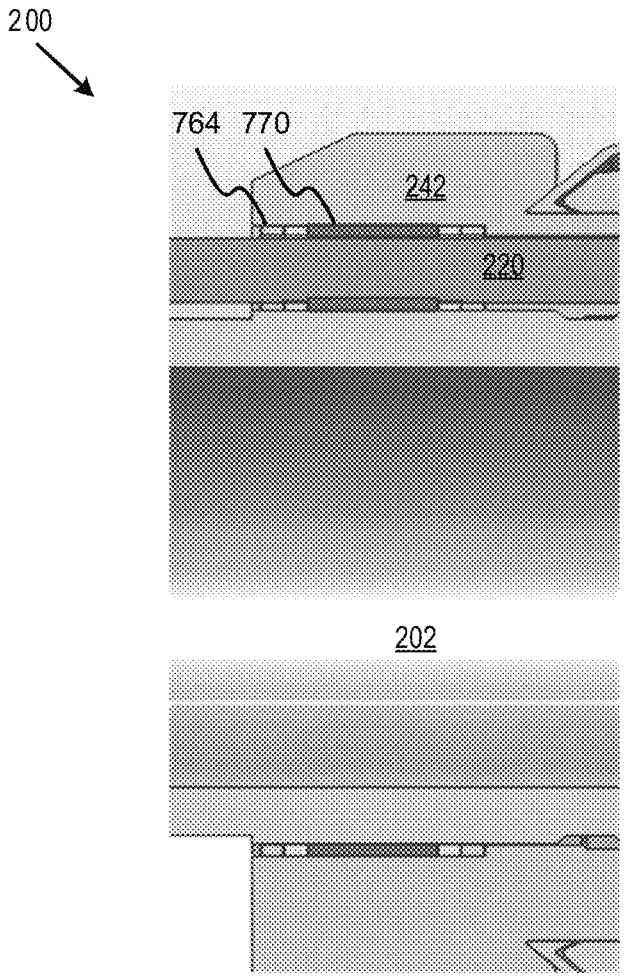
FIG. 9 is a side view of a sealing and locking element, according to some implementations.

As shown in FIG. 9, the ring 764 is positioned about the packer mandrel 202. The ring 764 may engage and be positioned within an uphole end of the element mandrel 242. The elastomer portion 770 will surround the control line 220 and provide a seal between the packer 200 and the control line.

FIG. 10A-FIG. 10F illustrate another embodiment of a sealing and locking element 1060 and installation of the control line 220 with a packer. In this embodiment, the sealing and locking element 1060 are combined as a seal ring 1004 which uses a back up ring 1001 retained with a threaded cap 1002. The packing element assembly with the sealing and locking element 1060 as shown in FIG. 10A will be on the rig without the seal and is lowered over the packer mandrel 202 as shown and described above in at least FIG. 5A-FIG. 5C above. If installed the threaded cap 1002 is removed as shown in FIG. 10B and the back up ring 1001 is removed as shown in FIG. 10C The seal 1004 may then be installed about the control line 220, over packer mandrel 202 and under element mandrel 242 as shown in FIG. 10D.

The back up ring 1001 is then lowered to capture the seal ring 1004 as shown in FIG. 10E. Note that back up ring 1001 has a slot (not shown) for the control line 220 and does not spin during assembly. As shown in FIG. 10F, the threaded cap 1002 is then re-attached and assembly of the sealing and locking element 1060 with the packer is complete.

Figure 11:
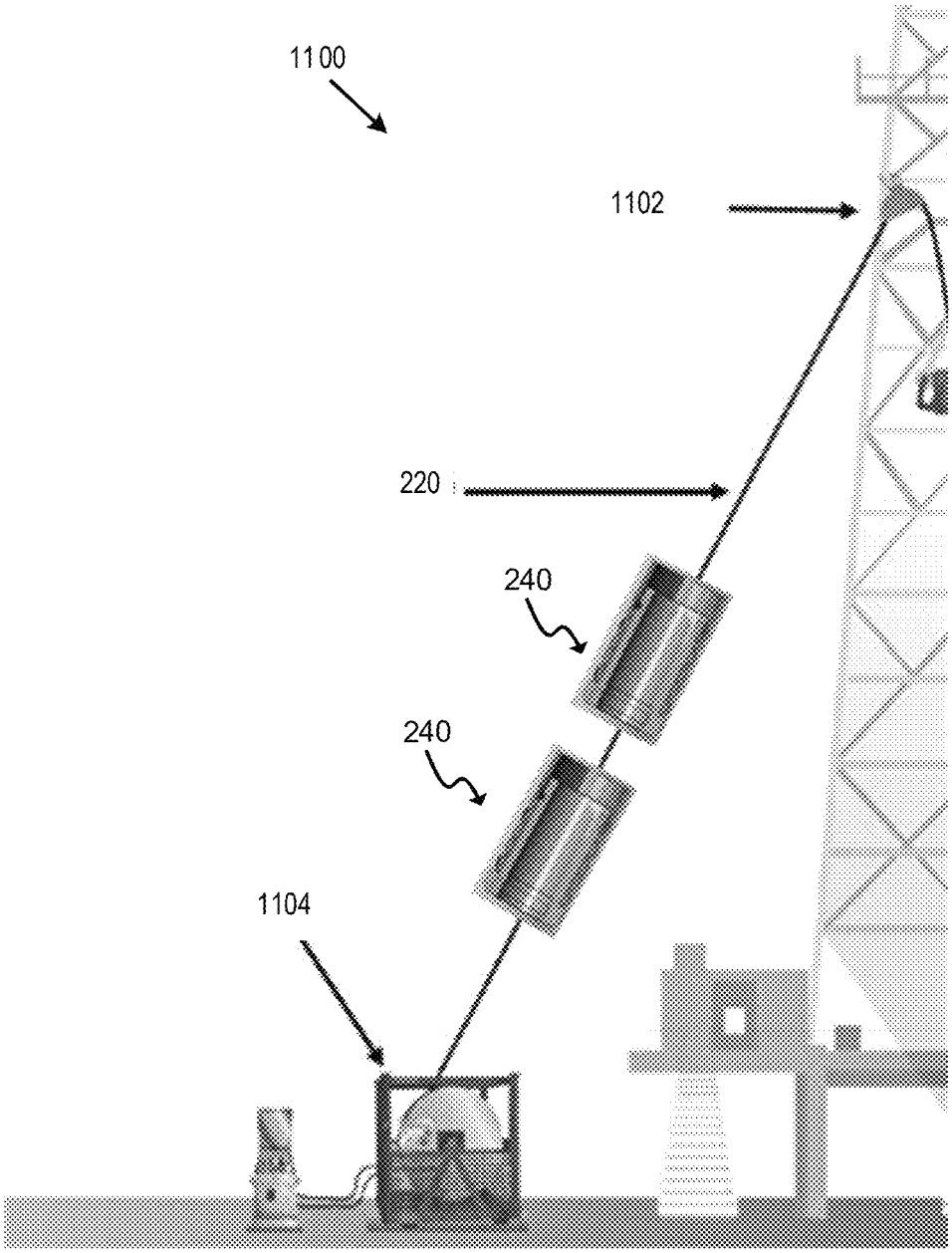
FIG. 11 is a diagrammatic illustration of a rig for installation of wellbore components, according to some implementations.

FIG. 11 illustrates another embodiment of an installation rig 1100 for installing one or more packing element assemblies 242 (element cartridges) onto mechanical packers placed within a wellbore. In this embodiment, instead of loading the packing element assemblies 240 after the sheave 1102, the packing element assemblies 240 may be installed on a spool 1104 prior to deployment of the rig 1100. In this example, the control line 220 must be taken out of the sheave 1102 during packer installation then remounted on the sheave 1102. Sheave 1102 may be designed in a way to facilitate removal and installation of the control line 220.

Figure 12A:
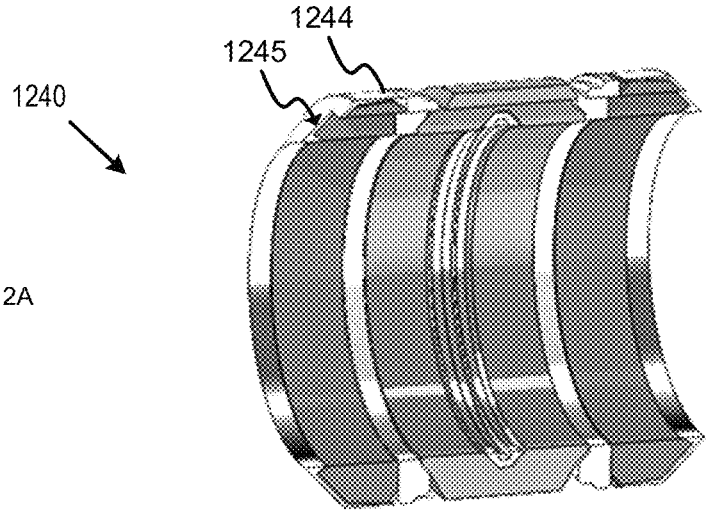
FIG. 12A-12C are perspective views of another embodiment of a packing element assembly for a packer, according to some implementations.
Figure 12B:
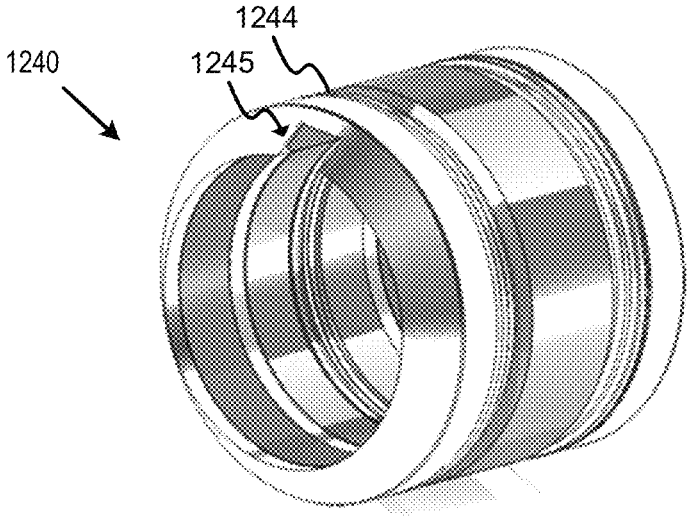
Figure 12C:
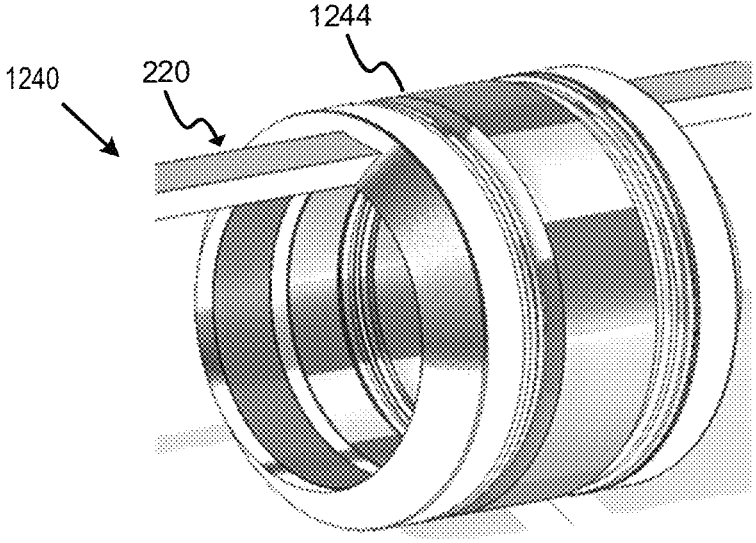

FIG. 12A-FIG. 12C illustrate another alternate embodiment of a packing element assembly 1240 to be coupled with a packer. In this embodiment, instead of having a packer element on a small mandrel as described in examples shown in FIG. 4-FIG. 5C above, an element 1244 may have an inner diameter (ID) cutout in the components of the element 1244 to house the control line 220 (flatpack or individual control lines). FIG. 12A is a cutaway view of the internal side of the element 1244. FIGS. 12B and 12C are perspective views. In this embodiment, a locking element is still needed to prevent lateral movement of the packer element after installation.

Figure 13:
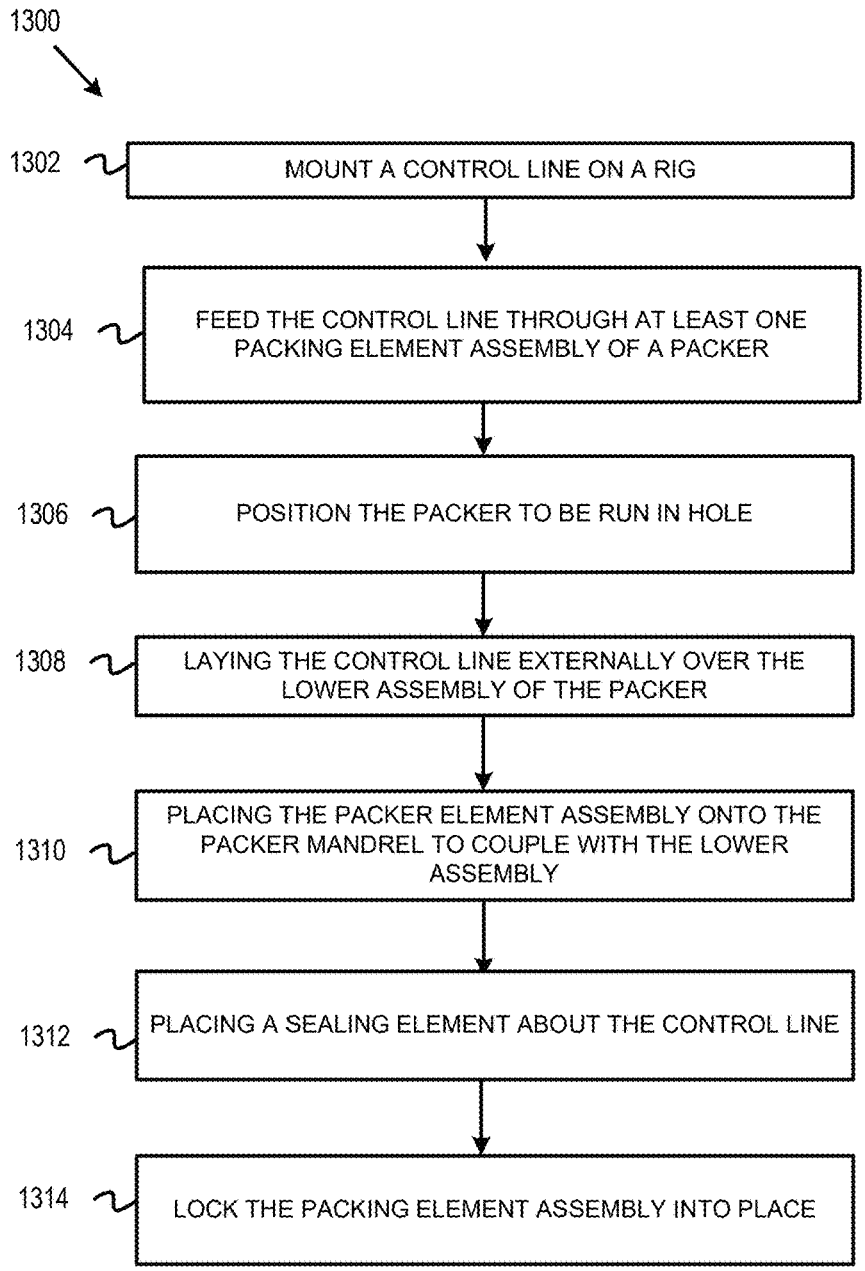
FIG. 13 is a flowchart illustrating a method, according to some implementations.

FIG. 13 illustrates a method 1300 for of preparing a feedthrough mechanical packer for installation into a wellbore. In a block 1302, a control line is mounted on a rig for installation into a wellbore. In a block 1304, the control line is fed through at least one packing element assembly of a packer, the packing element assembly including at least a packer element, and wherein the control line is positioned within an interior channel of the packing element assembly.

In a block 1306, a lower assembly of the packer is positioned into the wellbore. The lower assembly may include at least a packer mandrel and an anchoring element, and have at least one external channel configured to receive the control line therein. In a block 1308, the control line is laid externally over the lower assembly into the external channel.

In a block 1310, the packing element assembly is placed over the packer mandrel and coupled with the lower assembly. In a block 1312, a sealing element may also be placed about the control line. In a block 1314, the packing element assembly is locked into place to prevent lateral movement. In some examples, the lock and sealing element may comprise different components, and in other examples, may be one integral component with a locking element and a sealing element.

Blocks 1304 through 1314 may be repeated for other packers to be installed in the wellbore.

While the aspects of the disclosure are described with reference to various implementations and exploitations, it will be understood that these aspects are illustrative and that the scope of the claims is not limited to them. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may generally be integrated together in a single software product or packaged into multiple software products. Additionally, other implementations are within the scope of the following claims. In some cases, the actions recited in the claims may be performed in a different order and still achieve desirable results.

Example Implementations

Aspects disclosed herein include:

Aspect A: An apparatus to be positioned in a wellbore, the apparatus comprising a packer mandrel; and a packing element assembly including at least a packing element and an interior channel. A continuous control line is configured to be installed external to the packer mandrel and positioned in the interior channel of the packing element assembly without being spliced.

Aspect B: A system for use in a wellbore, comprising a downhole tool; a control line extending from an uphole end of the wellbore and coupled to the downhole tool; and a packer positioned above the downhole tool, the packer comprising: a packer mandrel; and a packing element assembly including at least a packing element and an interior channel. A continuous control line is configured to be installed external to the packer mandrel and positioned in the interior channel of the packing element assembly without being spliced.

Aspect C: A method comprising mounting a control line on a rig for installation into a wellbore; inserting the control line through a packing element assembly of a packer while the control line is mounted on the rig, the packing element assembly including at least a packing element and an interior channel for positioning the control line therein; positioning the packer to be run into the wellbore, the packer including a packer mandrel; laying the control line over the packer mandrel; and coupling the packing element assembly with the packer mandrel Aspects A, B, and C may have one or more of the following additional elem ents in combination:

Element 1: further comprising a locking element positioned about the packer mandrel to axially lock the packing element assembly.

Element 2: wherein the locking element is a snap ring.

Element 3: wherein the locking element includes a back up ring and a threaded cap.

Element 4: further comprising a sealing member positioned between the packing element assembly and the packer mandrel.

Element 5: wherein the sealing member includes a ring and a housing positioned on an external surface of the ring, wherein the housing has at least one split which opens for receiving the control line therein.

Element 6: wherein the housing comprises at least one of an elastomer portion, a metal portion, and a polymer portion.

Element 7: further comprising a lower assembly, the lower assembly positioned about the packer mandrel and including at least one external channel, wherein the continuous control line is configured to be installed in the at least one external channel.

Element 8: wherein the lower assembly further includes an anchor element, a setting piston and an upper cone positioned above the anchor element, and a lower cone positioned below the anchor element.

Element 9: wherein the packing element assembly is mounted on the rig.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. An apparatus to be positioned in a wellbore, the apparatus comprising:

a packer mandrel;

a packing element assembly including at least a packing element and a channel positioned along an interior surface of the packing element assembly; and a sealing member positioned between the packing element assembly and the packer mandrel;

wherein a continuous control line is configured to be installed external to the packer mandrel and positioned in the channel of the packing element assembly without being spliced; and wherein the sealing member includes a ring and a housing positioned on an external surface of the ring, wherein the housing has at least one split which opens for receiving the continuous control line therein.

2. The apparatus according to claim 1, further comprising a locking element positioned about the packer mandrel to axially lock the packing element assembly.

3. The apparatus according to claim 2, wherein the locking element is a snap ring.

4. The apparatus according to claim 2, wherein the locking element includes a back up ring and a threaded cap.

5. The apparatus according to claim 1, wherein the housing of the sealing member comprises at least one of an elastomer portion, a metal portion, and a polymer portion.

6. The apparatus according to claim 1, further comprising a lower assembly, the lower assembly positioned about the packer mandrel and including at least one external channel, wherein the continuous control line is configured to be installed in the at least one external channel.

7. The apparatus according to claim 6, wherein the lower assembly further includes an anchor element, a setting piston and an upper cone positioned above the anchor element, and a lower cone positioned below the anchor element.

8. A system for use in a wellbore, comprising:

a downhole tool;

a continuous control line extending from an uphole end of the wellbore and coupled to the downhole tool; and a packer positioned above the downhole tool, the packer comprising:

a packer mandrel; and a packing element assembly including at least a packing element, a sealing member, and a channel positioned along an interior surface of the packing element assembly;

wherein the continuous control line is configured to be installed external to the packer mandrel and positioned in the channel of the packing element assembly without being spliced; and wherein the sealing member includes a ring and a housing positioned on an external surface of the ring, and wherein the housing has at least one split which opens for receiving the continuous control line therein.

9. The system according to claim 8, further comprising a locking element positioned about the packer mandrel to axially lock the packing element assembly in place.

10. The system according to claim 9, wherein the locking element is one of a snap ring and a back up ring and threaded cap.

11. The system according to claim 8, wherein the housing of the sealing member comprises at least one of an elastomer portion, a metal portion, and a polymer portion.

12. The system according to claim 8, wherein the packer further includes a lower assembly positioned about the packer mandrel, the lower assembly including at least one external channel, wherein the continuous control line is configured to be installed in the at least one external channel.

13. A method, the method comprising:

mounting a control line on a rig for installation into a wellbore;

inserting the control line through a packing element assembly of a packer while the control line is mounted on the rig, the packing element assembly including at least a packing element, a sealing member, and a channel along an interior surface of the packing element assembly for positioning the control line therein;

wherein the sealing member includes a ring and a housing positioned on an external surface of the ring, and wherein the housing has at least one split which opens for receiving the control line therein;

positioning the packer to be run into the wellbore, the packer including a packer mandrel;

laying the control line over the packer mandrel;

coupling the packing element assembly with the packer mandrel; and sealing the control line.

14. The method according to claim 13, wherein the packing element assembly is mounted on the rig.

15. The method according to claim 13, wherein the housing of the sealing member comprises at least one of an elastomer portion, a metal portion, and a polymer portion.

16. The method according to claim 13, further comprising securing the packing element assembly into a fixed position by placing a locking element about the packer mandrel.

17. The method according to claim 13, wherein the packer further includes a lower assembly positioned about the packer mandrel, the lower assembly including at least one external channel, wherein the control line is configured to be installed in the at least one external channel.

18. An apparatus to be positioned in a wellbore, the apparatus comprising:

a packer mandrel;

a packing element assembly including at least a packing element, an element mandrel, and a channel positioned along an interior surface of the packing element assembly;

wherein a continuous control line is configured to be installed external to the packer mandrel and positioned in the channel of the packing element assembly without being spliced; and wherein the channel is positioned along an interior surface of the element mandrel.

* * * * *